US007017351B2

(12) United States Patent
Hao et al.

(10) Patent No.: US 7,017,351 B2
(45) Date of Patent: Mar. 28, 2006

(54) MINIATURE THERMOACOUSTIC COOLER

(75) Inventors: Zhili Hao, Marietta, GA (US); Mark Fowler, Madison, AL (US); Jay A. Hammer, Huntsville, AL (US); Michael Whitley, Madison, AL (US); David R. Brown, Meridianville, AL (US)

(73) Assignee: Mems Optical, Inc., Huntsville, AL (US)

( * ) Notice: Subject to any disclaimer, the term of this patent is extended or adjusted under 35 U.S.C. 154(b) by 0 days.

(21) Appl. No.: 10/717,604

(22) Filed: Nov. 21, 2003

(65) Prior Publication Data

US 2005/0000233 A1 Jan. 6, 2005

Related U.S. Application Data

(60) Provisional application No. 60/427,956, filed on Nov. 21, 2002.

(51) Int. Cl.
*F25B 9/00* (2006.01)

(52) U.S. Cl. ..... 62/6

(58) Field of Classification Search ..... 62/6; 310/309

See application file for complete search history.

(56) References Cited

U.S. PATENT DOCUMENTS 4,722,201 A * 2/1988 Hofler et al. ..... 62/6
4,858,441 A * 8/1989 Wheatley et al. ..... 62/6
4,948,360 A * 8/1990 Wells ..... 60/247
4,953,366 A * 9/1990 Swift et al. ..... 62/467
5,165,243 A * 11/1992 Bennett ..... 62/6
5,303,555 A * 4/1994 Chrysler et al. ..... 62/6
5,319,938 A * 6/1994 Lucas ..... 62/6
5,456,082 A * 10/1995 Keolian et al. ..... 62/6
5,480,764 A * 1/1996 Gal et al. ..... 430/321
5,561,984 A * 10/1996 Godshalk et al. ..... 62/51.1
5,901,556 A * 5/1999 Hofler ..... 62/6
5,914,553 A * 6/1999 Adams et al. ..... 310/309
6,133,670 A * 10/2000 Rodgers et al. ..... 310/309
6,384,952 B1 * 5/2002 Clark et al. ..... 359/224
6,574,968 B1 * 6/2003 Symko et al. ..... 62/6
2003/0223696 A1 * 12/2003 Salib et al. ..... 385/43

OTHER PUBLICATIONS

Hao, Zhili et al. "A Miniature Thermoacoustic Cryo-cooler Driven by a Vertical Comb-Drive." Proceedings of SPIE, vol. 4983 (2003), pp. 139-148.*

* cited by examiner

*Primary Examiner*—Cheryl Tyler
*Assistant Examiner*—Richard L. Leung
(74) *Attorney, Agent, or Firm*—Olds, Maier & Richardson, PLLC

(57) ABSTRACT

A MEMS based thermoacoustic cryo-cooler for thermal management of cryogenic electronic devices. The cryogenic cooling system can be integrated directly into a cryogenic electronic device. A vertical comb-drive provides an acoustic source through a driving plate to a resonant tube. By exciting a standing wave within the resonant tube, a temperature difference develops across a stack in the tube, thereby enabling heat exchange between heat exchangers. A tapered resonant tube improves the efficiency of the cooling system, compared with a simple cylinder configuration, leading to reduced harmonics and strong standing waves.

15 Claims, 3 Drawing Sheets

MINIATURE THERMOACOUSTIC COOLER

CROSS-REFERENCE TO RELATED APPLICATIONS

This application claims the benefit of U.S. provisional patent application No. 60/427,956 filed on 21 Nov. 2002. The disclosure of which is incorporated herein in its entirety by reference.

FIELD OF THE INVENTION

The present invention relates to a miniature thermoacoustic cooler. More particularly a miniature cryo-cooler driven by a vertical comb drive.

BACKGROUND OF THE INVENTION

Conventional, constant diameter resonant tube, thermoacoustic cooling devices have not been successfully applied to cryogenic temperatures. This is because piezoelectric drivers are used and they become less efficient at lower temperatures. For several reasons the magnitude of the piezoelectric effect (piezo gain) is dependent on the temperature. The piezoelectric effect is very stable at approximately room temperature. However, at cryogenic temperatures it reaches approximately 20% to 30% of its room temperature value.

Conventional, constant diameter resonant tube, thermoacoustic cooling devices suffer from several inefficiencies. First, the hysteresis of piezoelectric (PZT) drivers makes them less efficient than electrostatic drivers. Second, a constant diameter resonant tube (resonator) suffers from harmonic induced inefficiencies. Third, the assembly of the PZT driver, resonator and associated Micro-electromechanical Systems (MEMS) stack, can be difficult to directly integrate with electronics through wafer level bonding. The integration is difficult because these components may have to be assembled at component-level, instead of wafer-level, which is very costly and does not realize the benefits of batch-fabrication of MEMS technology.

SUMMARY OF THE INVENTION

Exemplary embodiments of the invention provide miniature coolers.

Exemplary embodiments of the invention provide thermoacoustic coolers.

Exemplary embodiments of the invention provide coolers with non-uniform cross sectional area resonance tubes.

Exemplary embodiments of the invention provide coolers for use in cryogenic cooling.

Exemplary embodiments of the invention provide coolers driven by vertical combs.

Exemplary embodiments of the invention provide cryogenic cooling systems that can be integrated directly into cryogenic electronic devices.

Further areas of applicability of embodiments of the present invention will become apparent from the detailed description provided hereinafter. It should be understood that the detailed description and specific examples, while indicating exemplary embodiments of the invention, are intended for purposes of illustration only and are not intended to limited the scope of the invention.

BRIEF DESCRIPTION OF THE DRAWINGS

Embodiments of present invention will become more fully understood from the detailed description and the accompanying drawings, wherein.

DETAILED DESCRIPTION OF EXEMPLARY EMBODIMENTS OF THE PRESENT INVENTION

The following description of exemplary embodiment(s) is merely illustrative in nature and is in no way intended to limit the invention, its application, or uses.

Exemplary embodiments of the invention provide a thermoacoustic cooling device which can have a resonance chamber operatively attached to an acoustic generator producing standing waves. The standing waves produce pressure differences, which in turn result in temperature gradients. Coupled with heat exchangers the device can operate as a cooling device, which can be attached to electronics.

Figure 4:
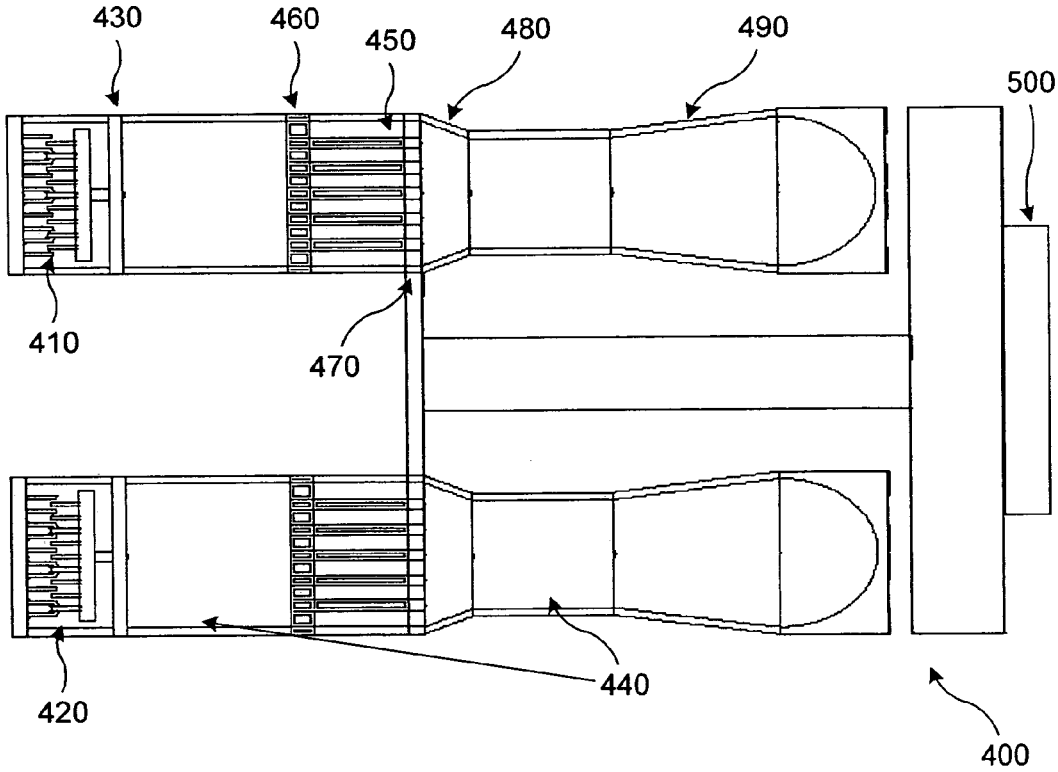
FIG. 4 illustrates a thermoacoustic cooler in accordance with exemplary embodiments of the invention integrated with electronics.

FIG. 4 illustrates a thermoacoustic cooler 400 in accordance with an exemplary embodiment of the invention. The thermoacoustic cooler 400 incorporates an acoustic source by utilizing a vertical comb-drive 410 sealed in an actuation chamber 420. The vertical comb drive 410 can be capable of producing mechanical power (e.g. 800 mW), which is enough to provide a cooling load (e.g. of 500 mW). Through the drive plate 430, the vertical comb-drive 410 creates an acoustic standing wave in the resonant tube 440. The tube 440 can be filled with an inert gas that can be pressurized to influence the performance of the cooler 400. A portion of the device called the stack 450 is the section used to transport the thermal energy from the gas in the system first and second sides of the stack (e.g., to hot and cold heat exchangers, 460 and 470, respectively). A taper 480 and buffer 490 volume in the resonator tube 440 can be used to improve its cooling efficiency. As the wave propagates through the device, heat flows between the gas and the stack 450, which sets up a temperature gradient. The stack 450 provides the means for the thermal energy to be moved up a temperature gradient. Two heat exchangers, 460 and 470, are attached at the both ends of the stack 450. The cold heat exchanger 470 removes heat from the cold temperature reservoir, such as cryogenic electronic components, and supplies it to the hot side of the stack 450, for example the environment. Thus, the heat dissipated from electronics 500 is pumped from the cold heat exchanger 470 to the hot heat exchanger 460 along the stack.

The power density in a thermoacoustic cooling device, in accordance with exemplary embodiments of the invention, can be proportional to the average pressure, p in the resonant tube. A choice of a large relative p is desirable for high cooling load, because . . . convective heat transfer increases with pressure. The power density is proportional to the average pressure in the resonant tube. For micro-sized resonance tubes, the fabrication process of the resonance tube (e.g. DRIE, thermal bonding, and the like) can restrict the maximum pressure in micro electro-mechanical (MEMS) devices. Fabrication processes in accordance with exemplary embodiments of the invention (e.g. gray scale etching, micro-machining, DRIE etching, and the like) can have various allowable pressures in the resonance tube (e.g., 2 atm). Additionally, when the device is cooled to cryo temperatures, the pressure will decrease (e.g. in one embodiment to approximately one third of its initial value).

Therefore, based on the fabrication and the performance requirement, the average pressure can vary (e.g. in one embodiment 0.6 atm). The dynamic pressure, pj, can be determined by the maximum force of the acoustic wave generator (e.g. vertical comb drive) and any non-linear constraints.

The resonance tube typically contains a gas (working gas, e.g., Helium, Neon, N2, CO2, and the like). Associated with the gas is a pressure and density, which affects the acoustic wave speed (speed of sound) in the gas. The speed of waves in relation to the speed of sound in the gas normally defines a Mach Number. In some exemplary embodiments of the invention linear wave motion is desired to transport energy in one-dimension. If linear motion of the waves are desired, Aerodynamic theory states that the Mach number of the working gas should be less than 0.1 to ensure linear gas motion. The choice of the working gas(es) can depend upon the desired property for a given use and environment (e.g. Noble gases for their thermal properties, air for economy and fabrication costs).

For an improved efficient transfer of energy, a large power density of the waves can be chosen. Thermoacoustic theory states that a large power density can he achieved by using a high acoustic frequency. Acoustic theory of wave propagation in a tube shows that the acoustic frequency must satisfy:

$$f = \frac{1.841a}{\pi D} \tag{1}$$

where a is the velocity of sound for the working gas and D is the diameter of the tube so that the motion is strictly a plane wave. The fabrication process can have an affect on material properties, which can also limit the acoustic frequency. For example the thermal penetration depth and the solid's thermal penetration depth, are related to the frequency. As the frequency increases, the thermal penetration depth decreases. A decrease in penetration depth increases the difficulty of fabrication of the resonance chamber, since the gap between the parallel-plates need be reduced, making the etching of these gaps very hard.

The frequency is also related to the length of the resonant tube. Since the resonant tube can be created from stacked semiconductors (e.g. silicon) by a combining process (e.g. bonding), the tube can be designed for various wavelength standing waves (e.g. a quarter wavelength standing wave). In exemplary embodiments of the invention a quarter wavelength resonance tube can be used. In other exemplary embodiments various wavelength resonator tubes can be used and the discussion herein should not be interpreted to limit the size (e.g. a half wavelength resonator can be used).

In an exemplary embodiment of the present invention a quarter wavelength resonator tube can be used. A quarter wavelength resonator tube reduces viscous loss compared to the half wavelength resonator tube. Additionally using a quarter wavelength resonator tube can reduce the complexity and bonding process by allowing for smaller (shorter) resonance tube. The tapered tube further reduces viscous loss and possible harmonics by reducing sharp edge transitions more shaping detail (sharp edge transitions) in the stacking.

Figure 1:
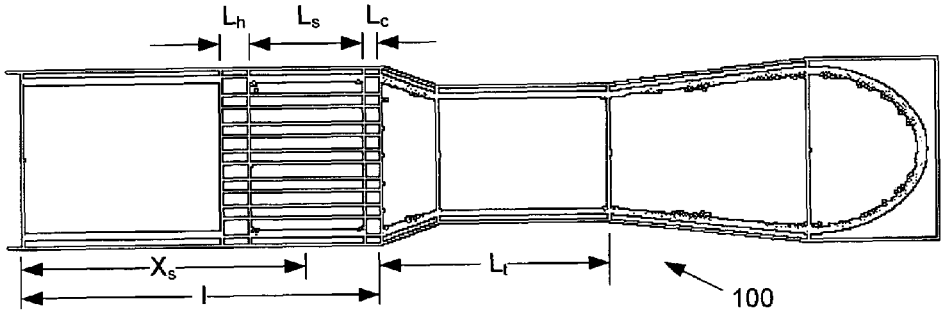
FIG. 1 illustrates a resonance tube of an exemplary embodiment of the invention.

A quarter wavelength standing wave can be created by forcing an acoustic pressure release at the end of the tube. This is simulated by creating a large open volume at the end of the tube. FIG. 1 shows an optimized quarter wavelength resonator tube 100 in accordance with an exemplary embodiment of the invention. The tube 100 reduces loss by creating a more continuous device by reducing sharp edge transitions. Additionally, the quarter wavelength resonance tube 100 reduces possible harmonics by its tapered shape, thus, leading to strong standing waves.

In accordance with exemplary embodiments of the invention several micro-machining and etching technologies (e.g. gray scale technologies and methods) can be used to fabricate the elements of a thermoacoustic cooler in accordance with exemplary embodiments of the invention. Gray scale technology can be used to cost effectively improve the efficiency of the thermoacoustic cryo-cooler by using one mask and one etching process to fabricate the curved contours that can be both perpendicular and parallel to the etching direction used to form a resonance tube.

In an example of one method of formation of a resonance tube in accordance with exemplary embodiments of the invention, a first step is to coat a uniform photoresist on a substrate. A gray scale mask, containing the information of the curved contour in the etching direction, is exposed to UV irradiation. The photoresist is developed, and the thickness of the photoresist after development can depend on the local dose of UV irradiation, which is controlled by the gray scale mask. Hence, the developed photoresist profile contains the information of the 3D microstructure. Finally, the complete 3D microstructure is transferred Into the substrate by etching step(s) (e.g. a dry etch step). Various etching times (time length of etching step(s)) and development times (time length of photoresist development) can be controlled to achieve a desired shape.

An advantage of gray scale etching techniques is that alignment error of elements of the formed 3-D structure (e.g. resonance tube) is reduced since the masks are written in a single step using different electron beam dosages to generate gray levels. Hence, gray scale etching enables the fabrication, of precise and arbitrarily shaped 3D microstructures. Although gray scale etching was discussed above in relation to fabrication of the 3-D structures forming thermoacoustic-cooling devices in accordance with exemplary embodiments of the invention, various other micro-machining and/or etching/fabrication techniques can be used (e.g. RIE, DRIE, and the like) in accordance with exemplary embodiments of the invention.

Figure 2A:
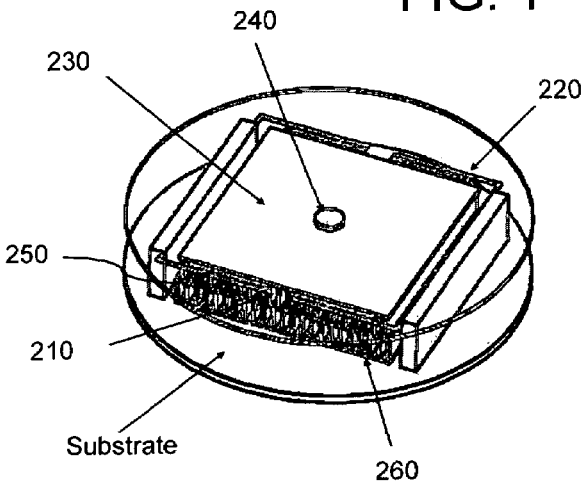
FIG. 2A illustrates an isometric view of a vertical comb drive in accordance with exemplary embodiments of the present invention.

In addition to a resonator tube, an acoustic generator generates the acoustic standing wave in the resonator chamber. In exemplary embodiments of the present invention, a vertical comb drive oscillates a drive plate forming acoustic waves. FIG. 2A shows a schematic view of a vertical comb-drive 200 in accordance with an exemplary embodiment of the invention. A slider 210 is suspended by the spring(s) 220 and connected to the acoustic drive plate 230 through a post 240. In an exemplary embodiment the actuator chamber 250 is kept near vacuum to avoid any air-damping effect, which is generally the dominant loss for electrostatic drivers. The displacement of the vertical comb-drive is-provided by an electrostatic force, which occurs between the stationary component called stator 260 and the mobile component called the slider 210. Upon the application of an AC voltage difference between slider 210 and stator 260, the drive plate 230 will vibrate producing an acoustic wave source. Both the spring 220 and drive plate 230 can be timed to match the acoustic frequency of the resonant tube 100. Although a vertical comb drive 200 is discussed as forming the acoustic generator in exemplary embodiments of the invention, other micro-oscillators can be used as known by those of ordinary skill in the arts and the discussion herein should not be interpreted to limit the acoustic generator to using a vertical comb drive.

Figure 2B:
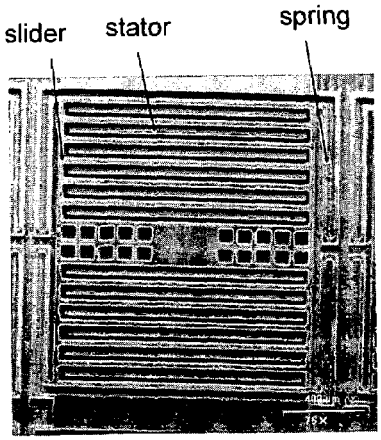
FIG. 2B shows a scanning electron microscope (SEM) image of a vertical comb drive in accordance with exemplary embodiments of the invention.
Figure 2C:
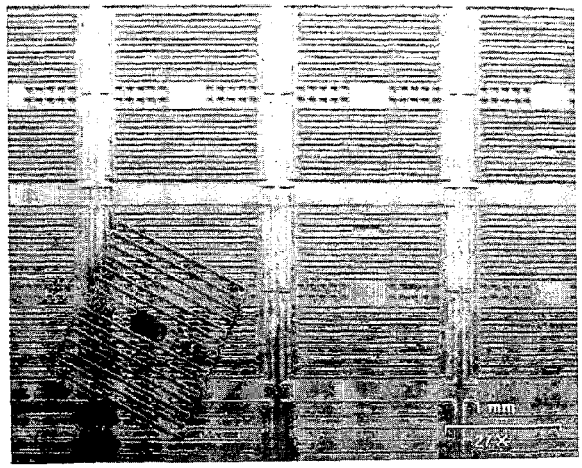

FIG. 2B shows a SEM picture of a vertical comb-drive in accordance with exemplary embodiments of the invention, which was fabricated using gray scale etching techniques. For mass production the vertical comb-drives can be fabricated in arrays, as shown in FIG. 2C, reducing the overall unit cost. Several factors (e.g., the radius of the drive plate, the thickness of the drive plate, the spring properties, and the like) of the vertical comb drive can be varied depending upon the acoustic wave properties desired (e.g., resonance).

Figure 3A:
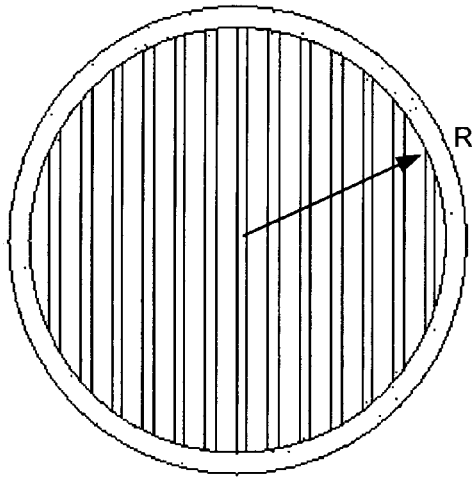
FIG. 3A illustrates a top view of a stack and heat exchanger in accordance with exemplary embodiments of the invention.
Figure 3B:
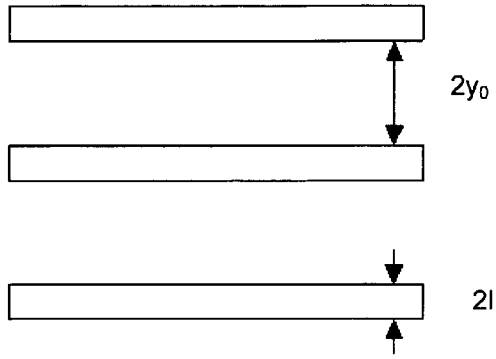
FIG. 3B illustrates a side expanded view of a stack and heat exchanger in accordance with exemplary embodiments of the invention.
Figure 3C:
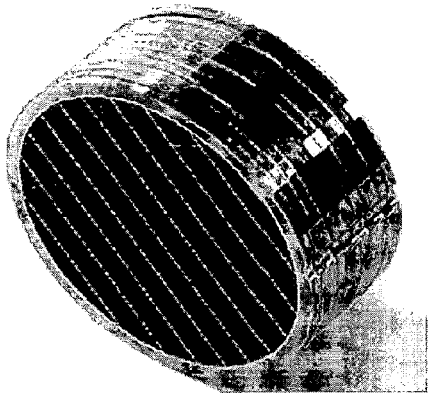
FIG. 3C show an image of a stacked heat exchanger in accordance with exemplary embodiments of the invention.

Other elements of a thermoacoustic cooling device in accordance with exemplary embodiments of the invention are heat exchangers and stacks. By exciting a standing wave within the resonant tube, a temperature difference develops across a stack in the tube, thereby enabling heat exchange between two heat exchangers. FIGS. 3A and 3B show a top view and a side expanded view respectively of a stack. The geometrical parameters of the stack include: 1) Stack length: $L_s$ 2) Stack center position: $x_s$ 3) Plate thickness: 2I; and 4) plate spacing $2y_0$. $L_c$ and $L_h$ are the length of the cold and hot heal exchangers, respectively. The parallel-plate stack is placed in a gas-filled resonator with a radius of R.

Based on thermoacoustic theory the gas region, which participates in the thermoacoustic process, can be within the thermal penetration depth, $\delta_k$ of the gas, which can be expressed as:

$$\delta_k = \sqrt{\frac{2k}{\omega\rho_m C_p}} \tag{2}$$

Where, k and $C_p$ denotes the thermal conductivity and specific heat of the working gas, respectively. $\rho_m$ and $\omega$ are the average density of the working gas and angular operation frequency.

In order not to effect the acoustic field and to fully use the space occupied by the stack, the gap between two adjacent plates can be $2\delta_x<2y_0<2\delta_s$ where $y_0$ is the gap spacing between the plates and $\delta_s$ is the plate solid's thermal penetration, which is the distance the heat can diffuse through the solid during a wave period. To provide an adequate amount of heat storage capability, the plate thickness could satisfy $2\delta_s<2I$, where the solid's penetration can be expressed as:

$$\delta_s = \sqrt{\frac{2k_s}{\omega\rho_s C_s}} \tag{3}$$

Where, $k_s$, $\rho_s$, and $C_s$, are the thermal conductivity, density and specific heat of the solid of the parallel plates (e.g. silicon dioxide).

In an exemplary embodiment of the invention the normalized cooling load $Q_{cn}$ and normalized acoustic power $W_n$ of a cyro-cooler, using boundary layer and short-stack approximations, can be expressed as:

$$Q_{cn} = \frac{-\delta_{kn}D^2\sin(2x_{sn})}{8\gamma(1+\sigma)\Lambda}\left\{\frac{\Delta T_{mn}\tan(x_{sn})}{(\gamma-1)BL_{sn}}\left[\frac{1+\sqrt{\sigma}+\sigma}{1+\sqrt{\sigma}}\right]-\left(1+\sqrt{\sigma}-\sqrt{\sigma}\,\delta_{kn}\right)\right\} \tag{4}$$

$$W_n = \frac{\delta_{kn}L_{sn}D^2}{4\gamma}((\gamma-1)B\cos^2(x_{sn}))\left[\frac{\Delta T_{mn}\tan(x_{sn})}{BL_{sn}(\gamma-1)(1+\sqrt{\sigma})\Lambda}-1\right]-\frac{\delta_{kn}L_{sn}D^2}{4\gamma}\left[\frac{\sqrt{\sigma}\sin^2(x_{sn})}{B\Lambda}\right] \tag{5}$$

where $\Lambda = 1-\sqrt{\sigma}\,\delta_{kn}+\frac{1}{2}\sigma\delta_{kn}^2$;

the normalized stack length is $L_{sn}=\kappa L_s$;
the normalized stack position is $x_{sn}=\kappa x_s$;
the normalized thermal penetration depth is $$\delta_{kn} = \frac{\delta_k}{y_0};$$

the normalized temperature difference is $$\Delta T_{mn} = \frac{\Delta T_m}{T_m};$$

the blocking ratio is $$B = \frac{y_0}{y_0+1};$$

the speed of sound is "a";
the wavenumber is $$\kappa = \frac{2\pi f}{a};$$

and
the Prandtl number is $\sigma=0.799$.

In exemplary embodiments of the invention the stack center position $x_s$ and the stack length $L_s$ can be chosen to optimize the cooling performance. The ratio of the temperature gradient along and to the stack and the critical temperature gradient, where the critical temperature gradient is a factor determining the output function of the thermoacoustic devices, can be less than one (1) for cooling.

In exemplary embodiments of the present invention the heat exchangers 460 and 470 can have the same geometry as the stack 450. The length of the heat exchanger $L_h$ and the length of the cold exchanger $L_c$ can be optimized to ensure the handling of imposed heat loads and to minimize viscous losses. The optimized values can be expressed as:

$$L_c = \frac{2p_1 \sin(\kappa \cdot 1)}{\omega \cdot p_m \cdot a} \quad (6)$$

$L_h = 2L_c$(7)

where ω is resonant frequency, $p_m$ is the average pressure in the resonant tube, is the dynamic pressure.

The description of the invention is merely exemplary in nature and, thus, variations that do not depart from the gist of the invention are intended to be within the scope of the embodiments of the invention. Such variations are not to be regarded as a departure from the spirit and scope of the present invention.

What is claimed is:

1. An apparatus, comprising:

a resonant tube in a micro-scale thermoacoustic device;

an acoustic driver, which creates a standing wave in said resonant tube, wherein the acoustic driver is a vertical comb-drive; and a stack configured to transport thermal energy from a gas in the resonant tube, wherein the stack has a first side and a second side, each positioned in a different position in the standing wave to create a thermal gradient between the first side and the second side.

2. The apparatus according to claim 1, wherein the first side is attached to a first heat exchanger and the second side is attached to a second heat exchanger.

3. The apparatus according to claim 1, wherein an electronic device is coupled to one side of the stack.

4. The apparatus according to claim 3, wherein the thermal gradient is established to transfer heat from the electronic device.

5. The apparatus according to claim 1, wherein the resonant tube is tapered.

6. The apparatus according to claim 5, wherein the tapered resonant tube is created using gray scale technology.

7. The apparatus according to claim 1, wherein the stack is at least one of a pin array, parallel array, and tapered pin array.

8. The apparatus according to claim 1, further comprising:

a device to be cooled, where the thermoacoustic device has a first heat exchanger that is operationally attached to the cooled device so as to transfer heat from the cooled device via the stack to a second heat exchanger in the thermoacoustic device.

9. A method comprising:

creating a standing wave in a resonant tube, wherein the standing wave is created by a vertical comb-drive; and transporting thermal energy from a gas in the resonant tube between a first side and a second side of a stack, wherein the first side and the second side are each positioned in a different position in the standing wave to create a thermal gradient between the first side and the second side.

10. The method of claim 9, further comprising:

attaching the first side to a first heat exchanger and the second side to a second heat exchanger.

11. The method of claim 9, further comprising:

coupling an electronic device to one side of the stack.

12. The method of claim 11, further comprising:

establishing the thermal gradient to transfer heat from the electronic device.

13. The method of claim 9, wherein the resonant tube is tapered.

14. A method comprising:

creating a standing wave in a resonant tube;

transporting thermal energy from a gas in the resonant tube between a first side and a second side of a stack, wherein the first side and the second side are each positioned in a different position in the standing wave to create a thermal gradient between the first side and the second side; and creating the resonance tube by gray scale etching such that there exists a taper in the resonance tube, where the tapered resonance tube allows standing waves and reduces the occurrence of harmonic waves.

15. The method of claim 14, further comprising:

constructing by gray scale etching sections; and bonding the sections together to form the resonance tube.

* * * * *